US006033246A

United States Patent [19]

Gilbert

[11] Patent Number: 6,033,246

[45] Date of Patent: Mar. 7, 2000

[54] TEST FIXTURE COMPLIANT CONNECTOR MOUNTING BRACKETRY

[75] Inventor: Mark L. Gilbert, Auburn, Calif.

[73] Assignee: Hewlett-Packard Company, Palo Alto, Calif.

[21] Appl. No.: 09/073,201

[22] Filed: May 4, 1998

[51] Int. Cl.[7] ..... H01R 13/64

[52] U.S. Cl. ..... 439/248; 439/247

[58] Field of Search ..... 439/247, 248

[56] References Cited

U.S. PATENT DOCUMENTS

| | | | |
|---|---|---|---|
| 4,944,568 | 7/1990 | Danbach et al. | 439/247 |
| 5,228,865 | 7/1993 | Douty et al. | 439/247 |

OTHER PUBLICATIONS

Mark L. Gilbert, "Unpublished sketches illustrating the prior art described in the Background Section of the Present Invention", Mar. 26, 1998, 3 pages.

*Primary Examiner*—Paula Bradley
*Assistant Examiner*—Katrina Davis

[57] ABSTRACT

A compliant mounting bracket for a connector is provided. The connector is physically connected to a plate. The connector extends through a connecting hole of a bracket. The bracket is for attachment to a fixture. The plate is attached to the bracket so that the plate is allowed movement with respect to the bracket. The movement, however, is limited so that the movement is within a predetermined tolerance from a nominal aligned position. A first elastic rod is placed in a position extending from a first hole in the bracket to a first hole in the plate. The first elastic rod holds the plate in the nominal aligned position with respect to the bracket and allowing movement within the predetermined tolerance. A second elastic rod also may be used.

16 Claims, 2 Drawing Sheets

TEST FIXTURE COMPLIANT CONNECTOR MOUNTING BRACKETRY

BACKGROUND

The present invention concerns electrical connectors and pertains particularly to test fixture compliant connector mounting bracketry.

In a manufacturing environment of electronic equipment, such as computer equipment, networking equipment or other electronic equipment, it is often desirable to facilitate the connection and disconnection of numerous cables to the device under test.

To facilitate efficient connection and disconnection of cabling, connectors for cabling from the testing equipment can be anchored using connector mounting bracketry. However, if there is no "give" in the connector mounting bracketry, problems can arise when there is a slight misalignment between the mounted connectors and the connectors from the device under test. This can become especially critical when on the device under test, several connectors are located close together.

Various types of brackets have been used to attempt to facilitate connection. For example, in an effort to overcome gravity, one solution is to hold the mating connectors in a bracket which is suspended at the end of long rods (i.e. cantilever beams). This solution does hold the connector in a "nominal aligned position"; however, this solution is too large to use in many instances, costly to fabricate, and difficult to assemble and use.

Another alternative is to hold the mating connectors in a bracket which is suspended by commercially available rubber "shock mounts" (blocks of rubber with metal studs attached to both ends) which hold the connector in the "nominal aligned position". However, this solution is too large to use in most instances, not generally available in "soft or compliant" enough materials so that there is not unacceptable stress on components, and is not easily scaled to use with small connectors.

Another alternative is to mount the connectors in a bracket which utilizes slots and spacers on the mounting screws, thus providing a degree of movement between the connector bracket and the mounting bracket. However, this solution is generally larger than minimal, does not hold the connector in the "nominal aligned position" because gravity causes it to rest "on the bottom", has more pieces than minimal, and requires precise machining.

Another alternative is to mount the connectors in a bracket which is attached to the mounting bracket by use of screws with special sleeves which have "O" rings around them. The "O" rings mate with precise and complex shaped holes in the mounting bracket. These "O" rings do hold the connector in the "nominal aligned position"; however, this solution is generally larger than minimal, has more pieces than minimal, requires precise machining, and does not generally provide sufficient compliance (allowance for movement to accommodate miss-location of connectors being mated).

SUMMARY OF THE INVENTION

In accordance with the preferred embodiment of the present invention, a compliant mounting bracket for a connector is provided. The connector is physically connected to a plate. The connector extends through a connecting hole of a bracket. The bracket is for attachment to a fixture. The plate is attached to the bracket so that the plate is allowed movement with respect to the bracket. The movement, however, is limited so that the movement is within a predetermined tolerance from a nominal aligned position. A first elastic rod is placed in a position extending from a first hole in the bracket to a first hole in the plate. The first elastic rod holds the plate in the nominal aligned position with respect to the bracket and allowing movement within the predetermined tolerance.

In the preferred embodiment of the present invention, a second elastic rod is also used. The second elastic rod is placed in a position extending from a second hole in the bracket to a second hole in the plate. The second elastic rod also holds the plate in the nominal aligned position with respect to the bracket when less than the minimal pressure is placed on the plate.

In the preferred embodiment, the plate is attached to the bracket using a first shoulder screw and a second shoulder screw. The first shoulder screw is inserted through a first clearance hole in the bracket. The first shoulder screw is then screwed into a first screw hole in the plate. The first clearance hole allows the plate movement with respect to the bracket. The movement is limited by the first clearance hole so that the movement is within the predetermined tolerance from the nominal aligned position. Likewise, the second shoulder screw is screwed into a second screw hole in the plate. The second clearance hole allows the plate movement with respect to the bracket. The movement is limited by the second clearance hole so that the movement is within the predetermined tolerance from the nominal aligned position.

Also in the preferred embodiment, the bracket is an "L" shaped bracket. The "L" shaped bracket has holes which allow attachment to the fixture. Further, the connector is attached to the plate via screw threads within a hole in the plate.

The present invention facilitates a connector being held in a nominal aligned position, yet allows for horizontal or vertical movement so that the connector may be mated with another connector not in the nominal aligned position. The present invention also overcomes the problem of gravity which often causes misalignment of connectors held in position with prior art brackets.

Compliant connector mounting bracketry in accordance with the present invention requires only near-minimal space, which makes such bracketry suitable for mating with connectors on products which are closely spaced. Prior art bracketry, however, are often bulky and cannot be implemented on individual mating connectors.

Compliant connector mounting bracketry in accordance with the present invention also may be easily and economically fabricated. Other prior art solutions often have numerous pieces which require precise fabrication and assembly.

Compliant connector mounting bracketry in accordance with the present invention also is usable for all sizes of connectors, merely by scaling the parts used in assembling the compliant connector mounting bracketry.

DESCRIPTION OF THE PREFERRED EMBODIMENT

Figure 1:
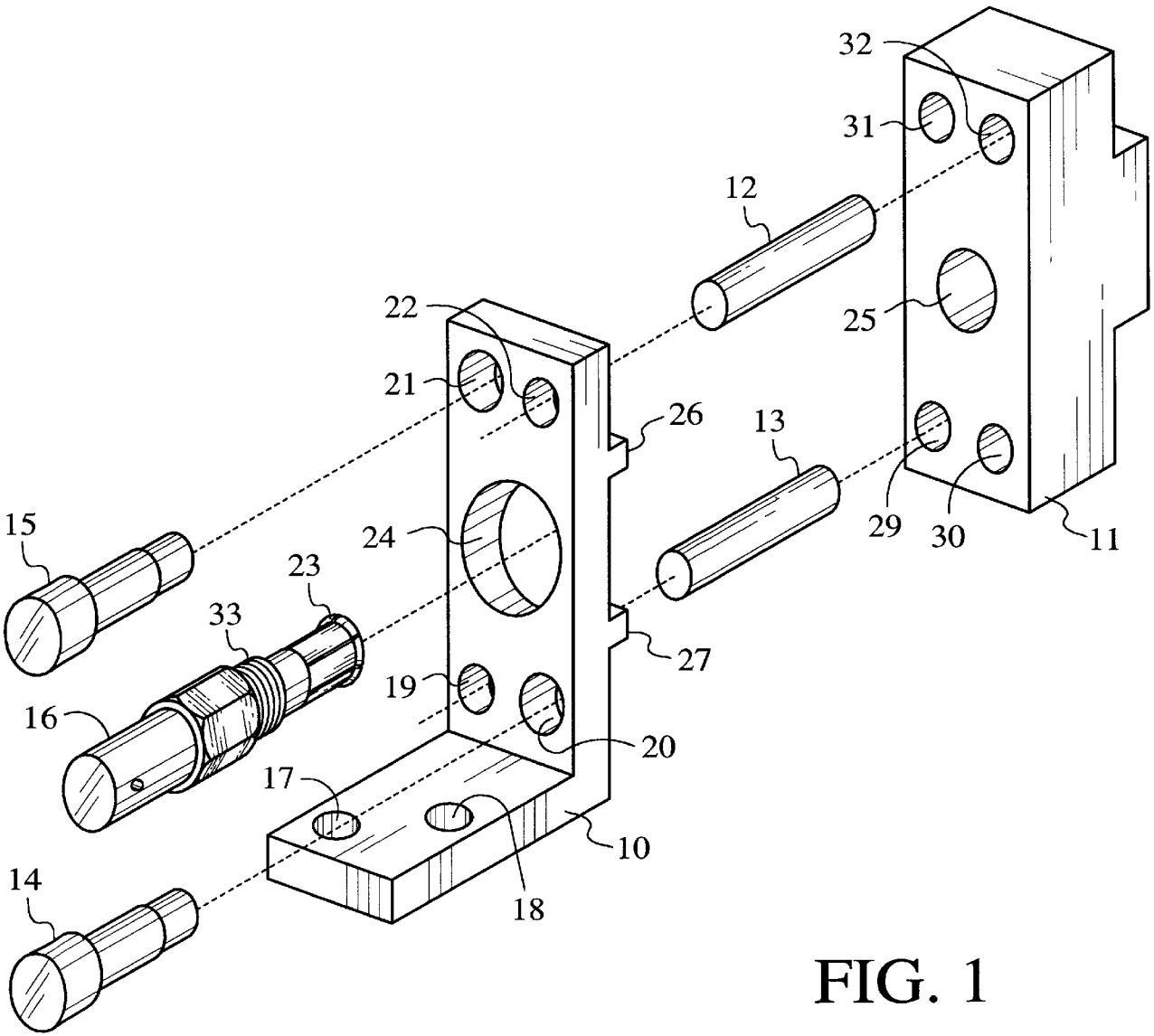
FIG. 1 shows an exploded view of compliant connector mounting bracketry in accordance with a preferred embodiment of the present invention.

FIG. 1 shows an exploded view of compliant connector mounting bracketry. The bracketry includes an "L" shaped bracket 10 which can be attached to a fixture via a screw hole 17 and a screw hole 18.

A rectangular plate 11 is machined to hold a connector 16 which is to be mated. Screw threads 33 of connector 16 are screwed into matching threads within a hole 25 of rectangular plate 11. A hole 24 is larger than the diameter of connector 16 by an amount equal to or larger than a tolerance which allows for misalignment of the location of a matching connector to be mated to connector 16. Prongs 23 and pin 35 (shown in FIG. 3) of connector 16 make electrical contact with the matching connector to be mated to connector 16.

A shoulder screw 15 is placed through a clearance hole 21 in "L" shaped bracket 10 and screwed into threads within a hole 31 within rectangular plate 11. Shoulder screw 15 is, for example, a commercially available screw with an integral sleeve spacer. Clearance hole 21 is larger than the sleeve spacer of shoulder screw 15 by an amount equal to the tolerance which allows for misalignment of the location of the matching connector to be mated to connector 16.

A shoulder screw 14 is placed through a clearance hole 20 in "L" shaped bracket 10 and screwed into threads within a hole 30 within rectangular plate 11. Shoulder screw 14 is, for example, a commercially available screw with an integral sleeve spacer. Clearance hole 20 is larger than the sleeve spacer of shoulder screw 14 by an amount equal to the tolerance which allows for misalignment of the location of the matching connector to be mated to connector 16.

A short cylindrical elastic rod 12 is inserted into a hole 22 in "L" shaped bracket 10 and a hole 32 within rectangular plate 11. Cylindrical elastic rod 12, for example, is constructed from rubber material available as "O" ring cord. Hole 22 and hole 32 each have diameters which match the diameter of cylindrical elastic rod 12. Likewise, a short cylindrical elastic rod 13 is inserted into a hole 19 in "L" shaped bracket 10 and a hole 29 within rectangular plate 11. Cylindrical elastic rod 13, for example, is also constructed from rubber material available as "O" ring cord. Hole 19 and hole 29 each have diameters which match the diameter of cylindrical elastic rod 13.

The compliant connector mounting bracketry is assembled by installing connector 16 through hole 24 of "L" shaped bracket 10 into rectangular plate 11. Cylindrical elastic rod 13 is inserted into hole 29 of rectangular plate 11. Cylindrical elastic rod 12 is inserted into hole 32 of rectangular plate 11. Rectangular plate 11 is placed up against "L" shaped bracket 10 being sure that the exposed ends of the elastic rod 12 and elastic rod 13 go into hole 22 and hole 19, respectively of "L" shaped bracket 10. Shoulder screw 15 is inserted through clearance hole 21 in "L" shaped bracket 10 and screwed into threads in hole 31 of rectangular plate 11. Shoulder screw 14 is inserted through clearance hole 20 in "L" shaped bracket 10 and screwed into threads in hole 30 of rectangular plate 11. The length of the sleeve of shoulder screw 14 and of shoulder screw 15 as well as a protrusion 26 and a protrusion 27 of "L" shaped bracket 10 separate the main portion of "L" shaped bracket 10 from rectangular plate 11 so that the tolerance built into clearance hole 20 and clearance hole 21 allows movement in the location of rectangular plate 11 with respect to "L" shaped bracket 10 in the plane perpendicular to shoulder screws 14 and 15. Cylindrical elastic rod 13 and cylindrical elastic rod 12 flexibly hold rectangular plate 11 in the nominal aligned position with respect to "L" shaped bracket 10. While in the preferred embodiment of the present invention shown in FIGS. 1, 2 and 3, protrusions 26 and 27 are used for separation, in other embodiments of the present invention, protrusions 26 and 27 may be omitted in order to reduce manufacturing costs.

Figure 2:
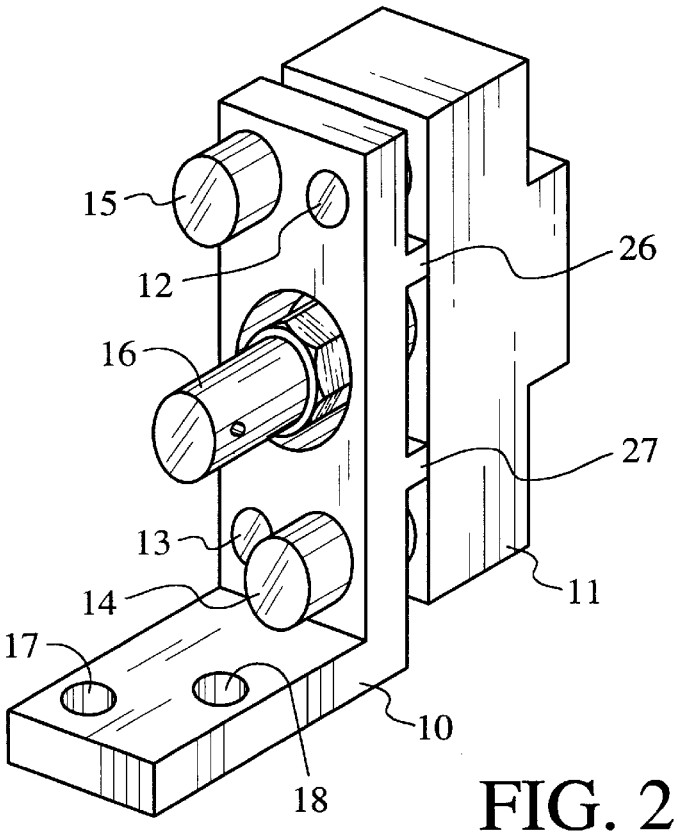
FIG. 2 and FIG. 3 show two different views of compliant connector mounting bracketry assembled in accordance with a preferred embodiment of the present invention.
Figure 3:
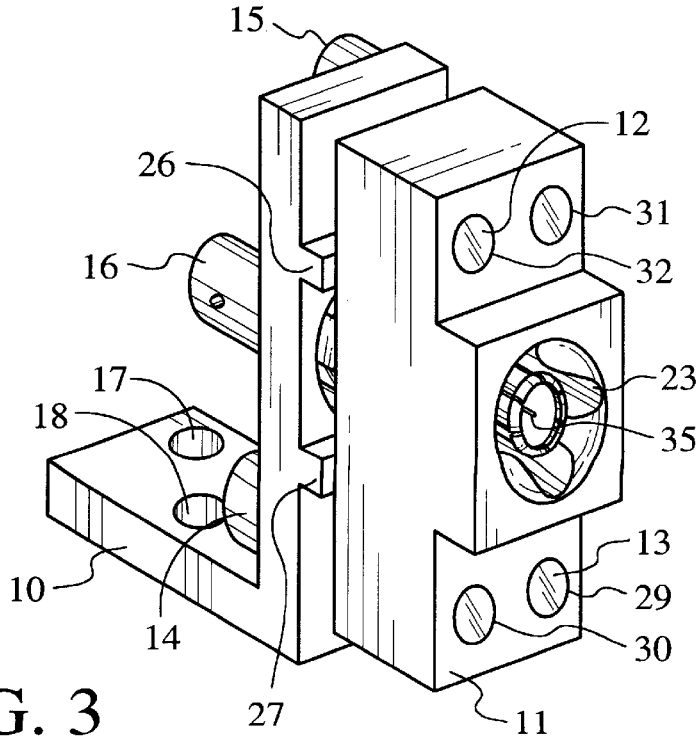

FIG. 2 shows the compliant connector mounting bracketry fully assembled. As shown in FIG. 3, the assembled bracketry is ready to attach to a fixture. The view of the assembled bracketry shows prongs 23 and pin 35 in position to make electrical connection to electrical components of the fixture. There is sufficient flexibility in assembled bracketry so that connector 16 can be adjusted to a suitable position such that when the fixture is actuated, the compliant connector mounting bracketry will mate connector 16 with the connector of a product even though the product connector may not be in an exactly aligned location.

While the preferred embodiment utilizes shoulder screw 14 and shoulder screw 15 to attach rectangular plate 11 to "L" shaped bracket 10, rectangular plate 11 can be attached to "L" shaped bracket 10 by other means. For example, box shaped brackets can be used for this purpose. In this case, cylindrical elastic rod 13 and cylindrical elastic rod 12, or similar elastic rods position the compliant connector mounting bracketry in the nominal location and also return the compliant connector mounting bracketry to the nominal location after each connector mating.

The foregoing discussion discloses and describes merely exemplary methods and embodiments of the present invention. As will be understood by those familiar with the art, the invention may be embodied in other specific forms without departing from the spirit or essential characteristics thereof. Accordingly, the disclosure of the present invention is intended to be illustrative, but not limiting, of the scope of the invention, which is set forth in the following claims.

I claim:

1. Compliant connector mounting bracketry, comprising:

a bracket for being attached to a fixture, the bracket having a connector hole through which a connector is placed;

a plate to which the connector is attached;

a connection means for holding the plate to the bracket, the connection means allowing movement of the plate with respect to the bracket, the movement being limited within a predetermined tolerance from a nominal aligned position; and a first elastic rod, extending from a first hole in the bracket to a first hole in the plate, the first elastic rod holding the plate in the nominal aligned position with respect to the bracket and allowing movement within the predetermined tolerance.

2. Compliant connector mounting bracketry as in claim 1, wherein the bracket is an "L" shaped bracket, the "L" shaped bracket having holes which allow attachment to the fixture.

3. Compliant connector mounting bracketry as in claim 1, wherein the connector is attached to the plate via screw threads within a hole in the plate.

4. Compliant connector mounting bracketry as in claim 1, additionally comprising:

a second elastic rod, extending from a second hole in the bracket to a second hole in the plate, the second elastic rod holding the plate in the nominal aligned position with respect to the bracket and allowing movement within the predetermined tolerance.

5. Compliant connector mounting bracketry as in claim 4, wherein the connection means includes:

a first shoulder screw inserted through a first clearance hole in the bracket and screwed into a first screw hole in the plate, the first clearance hole allowing the plate movement with respect to the bracket, the movement being limited by the first clearance hole so that the movement is within the predetermined tolerance from the nominal aligned position.

6. Compliant connector mounting bracketry as in claim 5, wherein the connection means additionally includes:

a second shoulder screw inserted through a second clearance hole in the bracket and screwed into a second screw hole in the plate, the second clearance hole allowing the plate movement with respect to the bracket, the movement being limited by the second clearance hole so that the movement is within the predetermined tolerance from the nominal aligned position.

7. Compliant connector mounting bracketry as in claim 1, wherein the connection means includes:

a first shoulder screw inserted through a first clearance hole in the bracket and screwed into a first screw hole in the plate, the first clearance hole allowing the plate movement with respect to the bracket, the movement being limited by the first clearance hole so that the movement is within the predetermined tolerance from the nominal aligned position.

8. Compliant connector mounting bracketry as in claim 7, wherein the connection means additionally includes:

a second shoulder screw inserted through a second clearance hole in the bracket and screwed into a second screw hole in the plate, the second clearance hole allowing the plate movement with respect to the bracket, the movement being limited by the second clearance hole so that the movement is within the predetermined tolerance from the nominal aligned position.

9. A method for providing a compliant mounting bracket for a connector, the method comprising the following steps:

(a) extending the connector through a connecting hole of a bracket and physically connecting the connector to a plate, the bracket being for attachment to a fixture; and, (b) attaching the plate to the bracket so that movement of the plate is allowed with respect to the bracket, the movement being limited so that the movement is within a predetermined tolerance from a nominal aligned position, including the following substep:

(b.1) placing a first elastic rod in a position extending from a first hole in the bracket to a first hole in the plate, the first elastic rod holding the plate in the nominal aligned position with respect to the bracket and allowing movement within the predetermined tolerance.

10. A method as in claim 9, wherein in step (a) the bracket is an "L" shaped bracket, the "L" shaped bracket having holes which allow attachment to the fixture.

11. A method as in claim 9, wherein step (a) includes attaching the connector to the plate via screw threads within a hole in the plate.

12. A method as in claim 9, wherein step (b) also includes the following substep (b.2) placing a second elastic rod in a position extending from a second hole in the bracket to a second hole in the plate, the second elastic rod holding the plate in the nominal aligned position with respect to the bracket when less than the minimal pressure is placed on the plate.

13. A method as in claim 12, wherein step (b) additionally includes the following substeps:

(b.3) inserting a first shoulder screw through a first clearance hole in the bracket, and (b.4) screwing the first shoulder screw into a first screw hole in the plate, wherein the first clearance hole allows the plate movement with respect to the bracket, the movement being limited by the first clearance hole so that the movement is within the predetermined tolerance from the nominal aligned position.

14. A method as in claim 13, wherein step (b) additionally includes the following substeps:

(b.5) inserting a second shoulder screw through a second clearance hole in the bracket, and (b.6) screwing the second shoulder screw into a second screw hole in the plate, wherein the second clearance hole allows the plate movement with respect to the bracket, the movement being limited by the second clearance hole so that the movement is within the predetermined tolerance from the nominal aligned position.

15. A method as in claim 9, wherein step (b) additionally includes the following substeps:

(b.2) inserting a first shoulder screw through a first clearance hole in the bracket, and (b.3) screwing the first shoulder screw into a first screw hole in the plate, wherein the first clearance hole allows the plate movement with respect to the bracket, the movement being limited by the first clearance hole so that the movement is within the predetermined tolerance from the nominal aligned position.

16. A method as in claim 15, wherein step (b) additionally includes the following substeps;

(b.4) inserting a second shoulder screw through a second clearance hole in the bracket, and (b.5) screwing the second shoulder screw into a second screw hole in the plate, wherein the second clearance hole allows the plate movement with respect to the bracket, the movement being limited by the second clearance hole so that the movement is within the predetermined tolerance from the nominal aligned position.

* * * * *